US005117510A

United States Patent [19]

Broussard et al.

[11] Patent Number: 5,117,510

[45] Date of Patent: Jun. 2, 1992

[54] HEADBAND CONSTRUCTION FOR SUPPORTING HEAD LAMPS

[76] Inventors: Douglas E. Broussard, 645 Colbert, Mandeville, La. 70448; Thomas G. Brousseau, P.O. Box 66511, Baton Rouge, La. 70896

[21] Appl. No.: 714,925

[22] Filed: Jun. 13, 1991

[51] Int. Cl.[5] ..... A42C 5/02

[52] U.S. Cl. ..... 2/209.2; 2/181; 2/DIG. 11; 362/105

[58] Field of Search ..... 2/181, 182.8, 185 R, 2/199, 209.1, 209.2, 422, DIG. 11; 362/105, 106

[56] References Cited

U.S. PATENT DOCUMENTS

| | | | |
|---|---|---|---|
| 1,566,891 | 12/1925 | Lyon | 2/181 |
| 4,360,930 | 11/1982 | Blanchard | 2/209.2 |
| 4,462,064 | 7/1984 | Schweitzer | 362/105 |
| 4,718,126 | 1/1988 | Slay | 362/105 |
| 4,797,793 | 1/1989 | Fields | 2/209.2 |
| 4,887,194 | 12/1989 | Fields | 2/209.2 |
| 4,918,757 | 4/1990 | Janssen | 2/DIG. 11 |
| 4,941,210 | 7/1990 | Konucik | 2/DIG. 11 |
| 4,970,631 | 11/1990 | Marshall | 362/405 |
| 5,034,862 | 7/1991 | Liston | 362/105 |

*Primary Examiner*—Werner H. Schroeder
*Assistant Examiner*—Diana L. Biefeld
*Attorney, Agent, or Firm*—Pravel, Gambrell, Hewitt, Kimball & Krieger

[57] ABSTRACT

A headband construction can support a pair of small flashlights on each side of a user's head. The headband features left and right pairs of buttonholes through which a flashlight is inserted on each side of the users head so that the flashlights can be oriented to point forwardly. This allows the user to support two flashlights which are forwardly facing.

17 Claims, 1 Drawing Sheet

HEADBAND CONSTRUCTION FOR SUPPORTING HEAD LAMPS

BACKGROUND OF THE INVENTION

1. Field of the Invention

The present invention elates to head wear and more particularly to an improved headband construction that can support a pair of penlights using closely spaced apart buttonholes and a clip arrangement that is positioned behind the buttonholes.

2. General Background

There are a number of small penlights or small flashlights that are commercially available which can fit in the pocket of a user. These small flashlights typically use one or two double A (AA) or Triple A (AAA) size batteries and are manufactured for example by Brinkman. One of these commercially available penlights is known by the trademark designation "Mini-Mag Lite".

These small flashlights are quite convenient in that they are very lightweight and easily stored. Many applications of hunters, fishermen and sportsmen require that a light be mounted on the head of the user such as a common headlamp. However, head lamps are bulky, usually requiring a large battery pack to mounted on the waist of the user in a belt supported holder. Further, head lamps usually require a three to four foot extension cord extending between the battery pack and the headlamp which interferes with several operations such as the safe operation of a boat, the carrying of heavy equipment and the like.

Thus, there is a need for a simple straight forward construction that supports a light or lamp on a headband construction yet allows the lamps to be quickly and easily removed so that the user can hand hold the light if desired.

SUMMARY OF THE PRESENT INVENTION

The present invention provides an improved headband construction that can support a pair of oppositely placed, preferably left and right penlights or small flashlights on the sides of the user's head and facing forward. The apparatus of the present invention provides a simplicity in its function, by utilizing buttonholes placed in fore and aft, closely spaced position on each side of the headband. The headband is preferably hollow, thus providing a central open space that is partially occupied by the penlight or flashlight during use. The headband also provides inner and outer band portions with the space therebetween. The outer surface portion of the headband provides the spaced apart buttonholes through which the flashlight is inserted. The front buttonhole provides an entry for the flashlight while the rear buttonhole provides an exit for the flashlight. A clip is positioned aft of the second buttonhole to which the rear of the flashlight can be affixed to prevent it from falling out when the user faces down.

Thus, the present invention provides a headband or sweatband apparatus that can be easily produced in large numbers using a hollow sweatband construction having the four described buttonholes.

The present apparatus thus provides an inexpensive yet simple and workable solution to the problem of supporting multiple penlights in a headband construction.

Further, the present invention provides a diversified holder in that the sweatband can be supported through the belt of the user, also supporting the lights with the headband.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
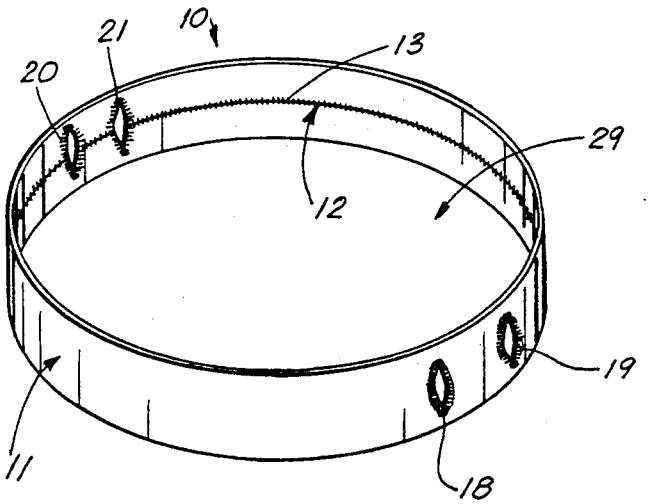
FIG. 1 is a perspective view of the preferred embodiment of the apparatus of the present invention.
Figure 2:
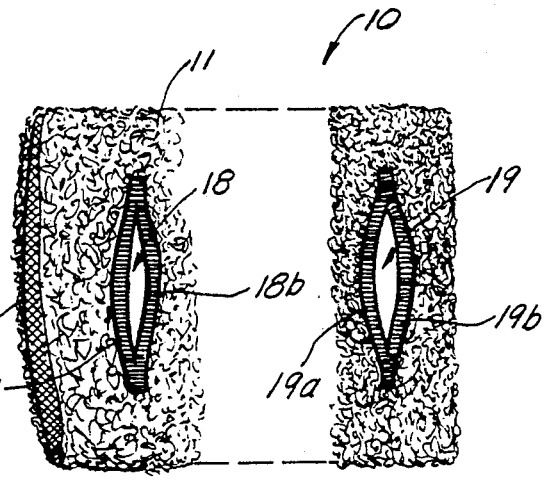
FIG. 2 is a fragmentary elevation view of the preferred embodiment of the apparatus of the present invention.
Figure 3:
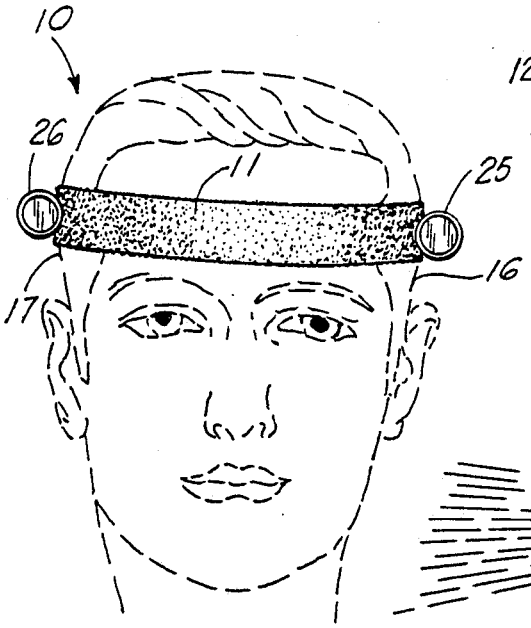
FIG. 3 is a front view of the preferred embodiment of the apparatus of the present invention shown on the head of a wearer.

In FIGS. 1–5, the preferred embodiment of the apparatus of the present invention is designated generally by the numeral 10. Headband 10 includes an outer headband wall 11 and an inner headband wall 12. The inner headband wall 12 can be provided with a seam 13 which creates an endless, circular cross-section when a single piece of material is sewed together at seam 13 to form the headband 10. The outer wall thus provides a continuous band of material such as terry cloth while the inner band 12 hides the seam 13 against the user's head as shown in FIG. 3.

In FIG. 2, a partial view of the apparatus 10 of the present invention is shown illustrating the outer wall 11 and the inner terry cloth wall 13. The outer wall 11 includes a pair of spaced apart buttonholes including a forward buttonhole 18, a rear buttonhole 19 on the left 16 side of the headband and a forward buttonhole 20 and rear buttonhole 21 on the right 17 side Of the headband. The buttonholes 18, 19 Can be stitched through both walls, 11, 12 of the headband 10 as shown in FIGS. 1 and 2. However, an alternate construction could be to provide the buttonholes 18, 19 and 20, 21 through only the outer wall 11 so that a portion of the flashlights 25, 26 would extend into the opening 22 and between wall 11 and wall 12.

Figure 4:
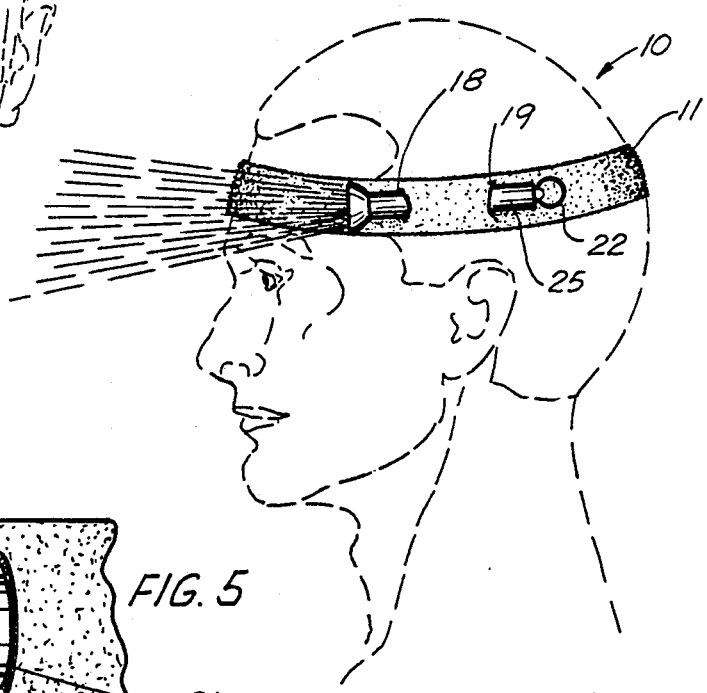
FIG. 4 is a side elevational view of the preferred embodiment of the apparatus of the present invention shown in use.
Figure 5:
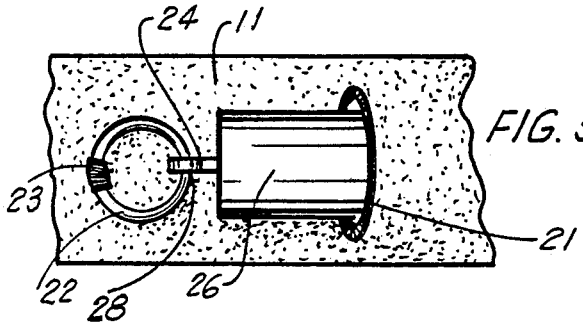
FIG. 5 is fragmentary side elevation view of the preferred embodiment of the apparatus of the present invention.

In FIGS. 3 and 4, headband 10 has been placed in operational position upon the head H of a user. The flashlights 25, 26 have been inserted through the buttonholes. In the front view of FIG. 3, the flashlights 25, 26 are respectively mounted on the left 16 and right 17 sides of headband 10.

In FIG. 4, a side view illustrates flashlight 25 inserted through buttonholes 18, 19. In the fragmentary view of FIG. 5, flashlight 26 is shown exiting rear buttonhole 21 and attached to headband 10 outer wall 11 using ring 22 which is fastened at stitching 23 to headband outer wall 11. The ring 22 can be attached at gusset of flashlight 26 which is typically provided commercially with flashlight 26. Gusset 24 has opening 28 therein for attachment to a key ring for example.

Each flashlight 25, 26 is thus secured to the headband by placement of each flashlight 25, 26 through its respective buttonholes 18, 19 and 20, 21. The flashlights 25, 26 are secured to the headband 10 even when removed from the head of the user. The headband 10 could be supported placing the user's belt through the center 29 of the headband 10 so that the headband would simply suspend from the user's belt with the lights 25, 26 attached thereto.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A headband construction or supporting a flashlight comprising:

a) a circular headband having inner and outer wall surfaces and upper and lower band edges;

b) at least the outer wall surface having a pair of buttonholes extending generally vertically between the upper and lower band edges and spaced along the band from front to rear, including a forwardly positioned buttonhole and a rearwardly positioned buttonhole which are closely spaced apart so that a small flashlight can be supported by the headband when inserted respectively through the pair of buttonholes; and c) the headband having a portion generally between he forward and rear button holes that defines a strip of headband material that covers and engages the flashlight along its length during use.

2. The headband construction of claim 1 further comprising clip means forming an interface between the flashlight and the headband for securing the headband against inadvertent removal.

3. The headband construction of claim 1 wherein the buttonholes are positioned about 1–4 inches apart.

4. The headband construction of claim 1 wherein he headband is of an absorbent material.

5. The headband construction of claim 1 wherein he headband is of a terry cloth material.

6. The headband construction of claim 1 wherein each button hole is a slotted, generally vertical opening having a stitched border.

7. The headband construction of claim 1 wherein he headband has an inner wall and an outer wall and each buttonhole extends through both the inner and outer wall.

8. The headband construction of claim 7 wherein each of the buttonholes forms a stitch, securing the inner and outer walls together.

9. A headband construction for supporting left and right flashlights comprising:

a) a circular headband having inner and outer wall surfaces;

b) at least the outer wall surface having left and right pairs of buttonholes, each pair of buttonholes including a forward button hole and a rear buttonhole which are closely spaced apart so that a pair of small flashing lights to be supported by the headband can be inserted respectively through the left and right pairs of buttonholes; and c) the headband having a portion generally between the forward and rear button holes that defines a strip of headband material that covers and engages the flashlight along its length during use.

10. The headband construction of claim 9 wherein he headband has upper and lower parallel edges and each button hole is generally perpendicular to the parallel edges.

11. The headband construction of claim 9 where the headband has upper and lower parallel edges and each button hole extends between and approaching the upper and lower edges.

12. The headband construction of claim 9 wherein the band is defined by inner and outer wall potions with a space therebetween.

13. A headband construction for supporting left and right flashlights comprising:

a) a circular headband having inner and outer wall surfaces;

b) at least the outer wall surface having left and right oasis of vertical slots, each pair of vertical slots including a forward vertical slot and a rear vertical slot which are closely spaced apart so that a pair of small flashlight to be supported by the headband can be inserted respectively through the left and right pairs of vertical slots; and c) the headband having a portion generally between the forward and rear button holes that defines a strip of headband material that covers and engages the flashlight along its length during use.

14. The headband construction of claim 13 wherein he headband has upper and lower parallel edges and each vertical slot is generally perpendicular to the parallel edges.

15. The headband construction of claim 13 where the headband has upper and lower parallel edges and each button hole extends between and approaching the upper and lower edges.

16. The headband construction of claim 13 wherein the band is defined by inner and outer wall portions with a space therebetween.

17. A headband construction for supporting a flashlight comprising;

a) a circular headband having inner and outer wall surfaces and upper and lower band edges;

b) at least the outer wall surface having a pair of vertical slots extending generally vertically between the upper and lower band edges and along the band from front to rear, including a forwardly positioned vertical slot and a rearwardly positioned vertical slot which are closely spaced apart so that a small flashlight can e supported by the headband when inserted respectively through the pair of vertical slots; and c) the headband having a portion generally between the forward and rear button holes that defines a strip of headband material that covers and engage the flashlight along its length during use.

* * * * *